United States Patent [19]

Montalvo

[11] Patent Number: 4,972,605

[45] Date of Patent: Nov. 27, 1990

[54] INSULATION SYSTEM FOR CLOTHES DRYER APPARATUS

[76] Inventor: Guy L. Montalvo, 740 Main St., Cottonport, La. 71327

[21] Appl. No.: 337,849

[22] Filed: Apr. 14, 1989

[51] Int. Cl.[5] ..... F26B 3/00

[52] U.S. Cl. ..... 34/35; 34/86; 34/133; 34/243 R

[58] Field of Search ..... 34/133, 243 R, 86, 35

[56] References Cited

U.S. PATENT DOCUMENTS

| | | | |
|---|---|---|---|
| 3,435,537 | 4/1969 | Rumsey | 34/133 |
| 3,611,584 | 10/1971 | Hewson | 34/133 |
| 3,922,798 | 12/1975 | McMillian | 34/133 |

*Primary Examiner*—Henry A. Bennet

*Attorney, Agent, or Firm*—Pravel, Gambrell, Hewitt, Kimball & Krieger

[57] ABSTRACT

The exterior/interior system for insulating the walls, top, and floor of a typical gas or electric dryer of the type having an interior drum which rotates, and in which electric or gas heat is provided into the drum, for drying the clothes contained within the drum. The two systems would provide a plurality of insulated panels, each of the insulated panels comprising a layer of insulation in the form of a rectangle. The exterior system comprising a durable outer exterior colored surface. Each of the insulated panels conforming to the width and length of the six sides of a dryer, i.e., the side portions, front and rear portions, the top of the dryer and the floor portion of the dryer. There would be further included an insulated panel for placing on the exterior door wall or between the interior-exterior door walls of the dryer, which gives access to the interior drum.

6 Claims, 5 Drawing Sheets

INSULATION SYSTEM FOR CLOTHES DRYER APPARATUS

BACKGROUND OF THE INVENTION

1. Field of the Invention

The apparatus of the present invention relates to clothes dryers. More particularly, the present invention relates to a system for insulating either the interior or the exterior walls of a clothes dryer in order to reduce the amount of heat necessary to dry the clothes, and to cut down on the time required to dry clothes thereby conserving substantial amount of energy.

2. General Background

In the present state of the art of drying clothes, the most common dryers are the types which are electric or gas powered, and include a drum having a round exterior wall, the drum rotatably mounted in a frame, with the frame incorporating the four side walls, top and bottom portion, and a system for both providing a source of either gas or electric heat into the drum, and a motor for rotating the drum during the drying cycle. Of course, most of such dryers are sold by national brands such as Sears, Maytag, or the like, and provide a system of controls and heat ranges for drying specific quantities and types of clothing. In addition, there is usually a front door on the frame of the dryer for allowing the placing in and removing of the clothes after the clothes have been dried.

It is well known, that such a system of drying is quite effective in the drying of clothes, over a period of time, but does not address the question of the amount of heat that is required to heat the clothes that are tumbling in the drum in order to dry the clothes, and the amount of heat that is lost to the exterior during the process. For in all cases, the gas or electric dryer have no insulation system at all; therefore, a vast quantity of the heat that is being targeted into the drum where the clothes are contained, is lost around the drum and out of the frame of the dryer. Therefore, the drying time is extended, and the amount of heat and energy expended is a greater quantity than would be required. In Sun Belt States home air cooling systems must remove this unwanted additional heat. Again substantial energy saving would be realized in less operation of this home cooling system.

In the present state of the art, there has been patents which have been issued which address the question of clothes dryers and they are as follows:

| PATENT NO | INVENTOR | TITLE |
|---|---|---|
| 3,500,044 | Treadway | "Cover For Clothes Washer And Dryer" |
| 3,202,193 | Ware | "Protective Covering" |
| 3,579,647 | Nielson | "Toilet Tank Cover" |
| 3,320,996 | Singer | "Adjustable Cover" |
| 2,917,094 | Sullivan | "Cover For Shopping Carts" |
| 3,875,686 | Smoot | "Seal For Clothes Dryers" |
| 3,166,112 | Fisher | "Toilet Tank Cover Set" |

SUMMARY OF THE PRESENT INVENTION

What is provided is a system for insulating the walls, top, and floor of a typical gas or electric dryer, of the type having an interior drum which rotates, and in which electric or gas heat is provided into the drum, for drying the clothes contained within the drum. The system would provide a plurality of insulated panels, each of the insulated panels comprising a layer of insulation in the form of a rectangle. Each of the insulated panels conforming to the width and length of the six sides of a dryer, i.e., the side portions, front and rear portions, the top of the dryer and the floor portion of the dryer. There would be further included an insulated panel for placing on the door of the dryer, which gives access to the interior of the drum. Further, in order to secure the panels in place there would be provided a series of edge trims in the form of adhesive strips which would secure the panels at their edges to configure the complete insulated covering onto the dryer. In addition, each of the exterior panels would include a series of adhesive strips along there interior surface, for adhesively being mounted onto the sides of the dryer. Each of the insulated panels would include an interior facing foil surface exterior foil face and would serve to provide a means for reflecting the heat that is targeted for the drum within the dryer to be maintained within the drum, thus allowing greater heat build up within the drum to dry the clothes, and resulting in a less amount of energy required to complete the clothes drying process.

A second embodiment of the invention may include that the insulated panels which are adhesively adhered to the exterior of the dryer in the principal embodiment, adhere to the interior walls of the dryer, thus maintaining the exterior look to the dryer as was originally purchased, yet providing the insulated panels on all interior surfaces of the frame of the dryer so that the dryer is in fact totally insulated in its interior.

Therefore, it is a principal object of the present invention to provide a system for insulating dryers, in order to maintain the heat within the dryer as the clothes are tumbled in the drum within the dryer;

It is still a further object of the present invention to provide a system for insulating the walls of a dryer, so that less heat and less time is expended in the drying of clothes within the dryer and less energy is required;

It is still a further object of the present invention to provide an insulating system for electric or gas dryers which would help greatly reduce the amount of heat that would be released out into the ambient atmosphere of the room which the dryer is placed during the drying process; and It is still a further object of the present invention to provide a system for insulating gas and electric dryers, which is easy to install, and would effectively totally insulate the interior of the dryer from the exterior of the surrounding room.

These and other objects of this invention will be readily apparent to those skilled in the art from the detailed description and claims which follow.

BRIEF DESCRIPTION OF THE DRAWINGS

For a further understanding of the nature and objects of the present invention, reference should be had to the following detailed description, taken in conjunction with the accompanying drawings, in which like parts are given like reference numerals, and wherein.

DETAILED DESCRIPTION OF THE PREFERRED EMBODIMENT

Figure 1:
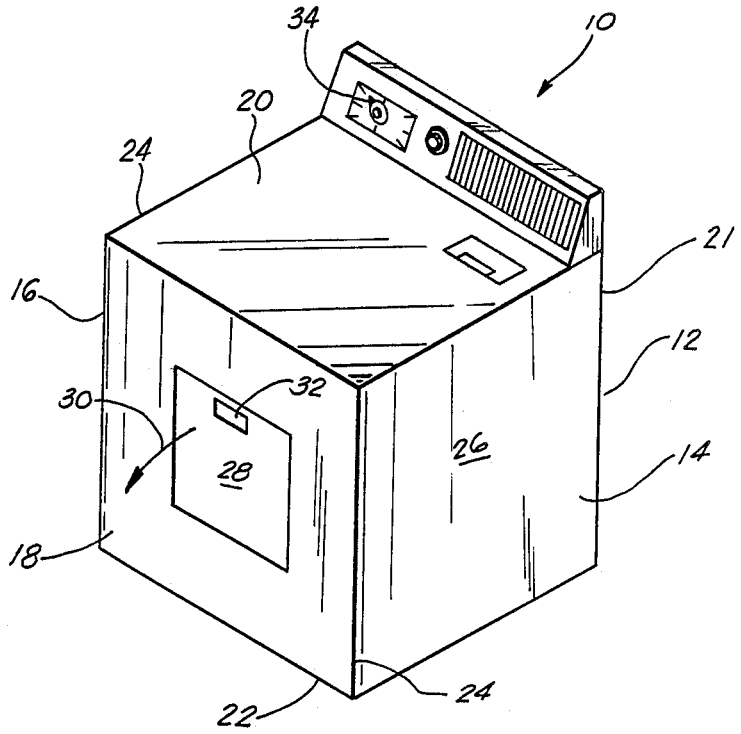
FIG. 1 illustrates a typical uninsulated dryer to be insulated in the present invention.
Figure 2:
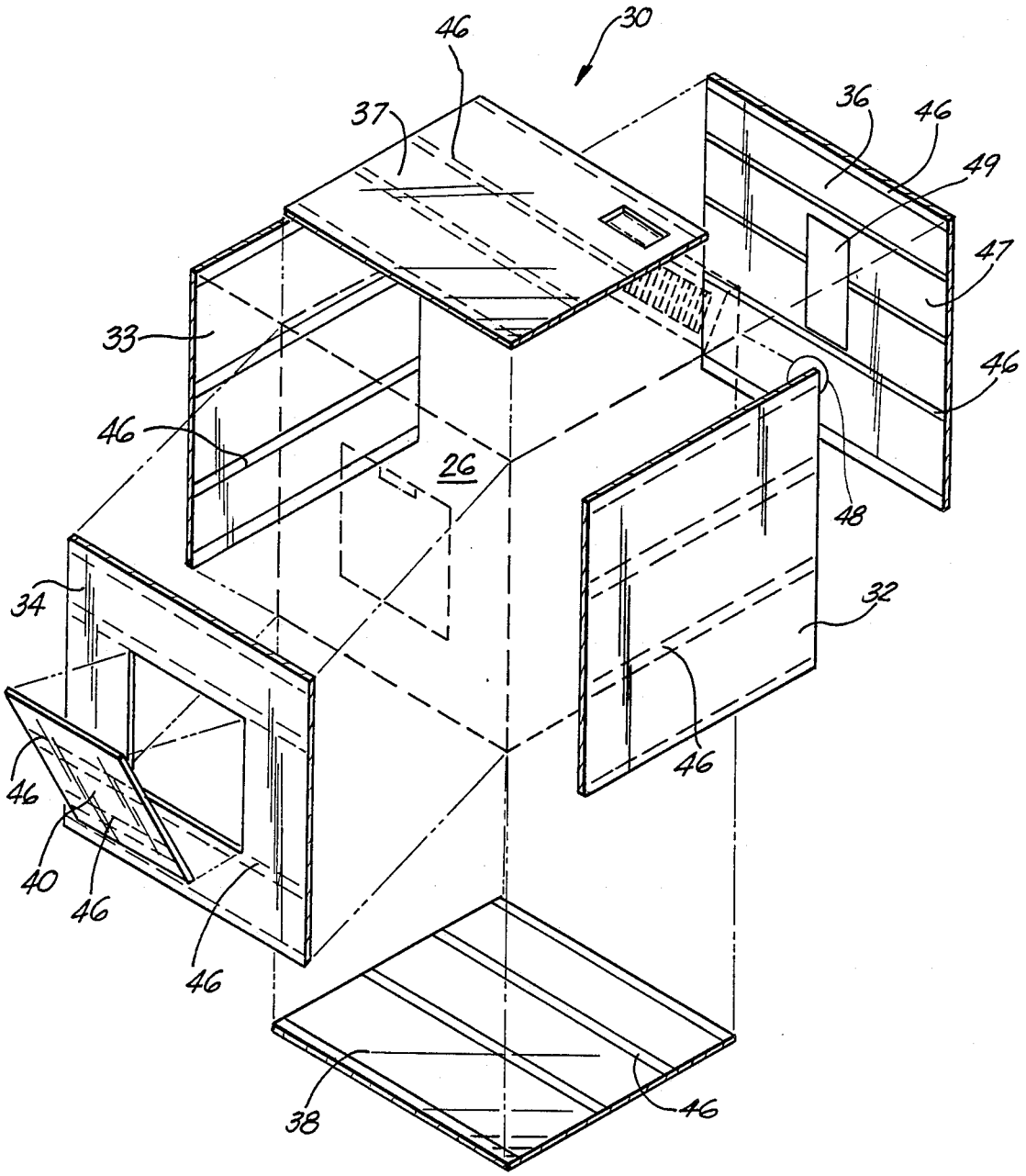
FIG. 2 illustrates an exploded view of the exterior insulation system of the present invention.
Figure 3:
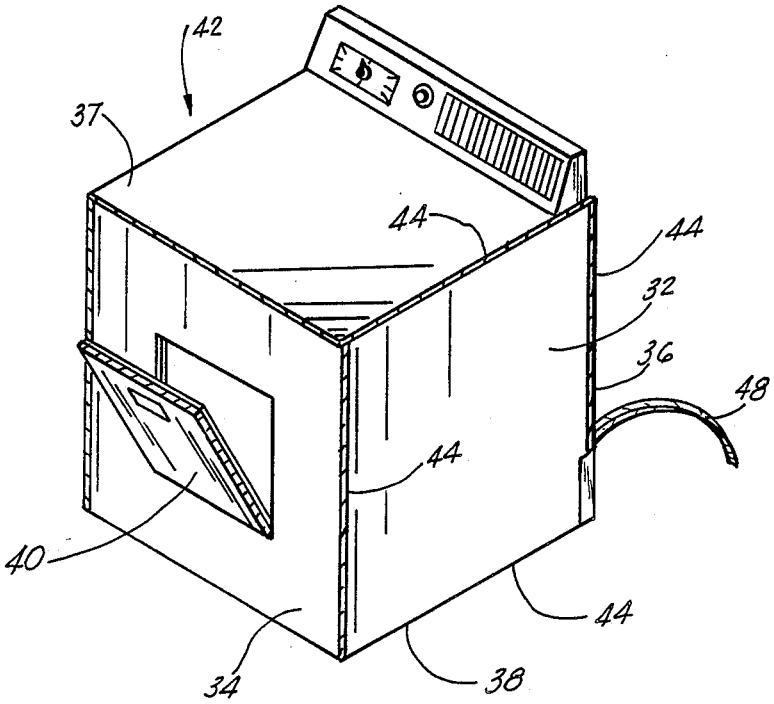
FIG. 3 illustrates an overall view of a dryer with the exterior insulation system partially installed.
Figure 4:
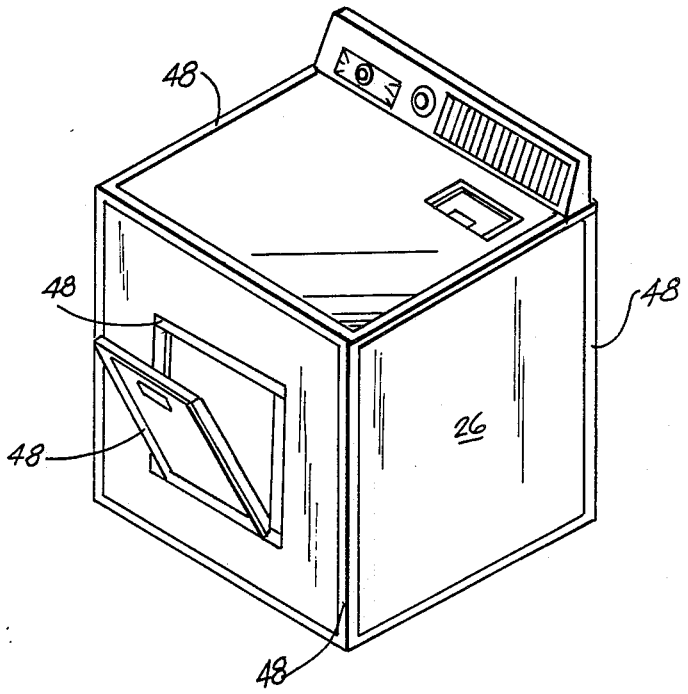
FIG. 4 illustrates an overall view of the exterior insulation system totally installed on a gas or electric dryer.

FIGS. 2 through 4 represent the preferred embodiment of the apparatus of the system of the present invention, with FIG. 1 illustrating a typical clothes dryer number 10 as the present invention is utilized with it. As illustrated in FIG. 1, clothes dryer 10 comprises a generally cubical framework 12 comprising a pair of side walls 14 and 16, a front wall 18 a rear wall 21, a top wall 20, a lower base wall 22 (not illustrated), each of the wall panels constructed of a type of material such as steel, aluminum, or other type of metal, and joined at their common edges 24 between the top, side walls, and bottom wall, to define the interior framework 26 therewithin. As further illustrated in FIG. 1, dryer 10 has a door 28 which would normally be hingedly engaged to the front panel 18, for opening in the direction of Arrow 30 by pulling on handle 32 for having access into the dryer itself. Further, there is illustrated control panel 34 which would generally consists of state of the art on and off controls, and heat adjustment controls for the dryer.

Although it is not illustrated, this type of dryer which is commonly known in the art and sold by major manufacturers such as Sears, Maytag would include an interior drum which would be mounted on a shaft or the like with the drum rotating within the framework 26 of dryer 10, and would further contain a source of heat such as electric or gas heat, which would be flowing into the drum when the dryer is in the on setting, so that any wet clothes contained in the drum would be tumbled therewithin and would be dried by the heat introduced therein. Of course, the door 28 would allow the introduction and receipt of clothes to and from the dryer prior to and after the drying cycle.

Turning now to the present invention, the present invention would introduce a system for insulating the walls 14, 16, 18, 20, 21, and 22 of the dryer, so that heat which is being introduced from the heat source of the dryer 10 into the drum (not illustrated) would be maintained within the interior 26 of the dryer, and would not radiate outward into the surrounding areas such as the room space in which the dryer is placed.

Turning now to FIG. 2, that system which would be numbered 30 in general, would include a plurality of panels, the panels incorporating a pair of side panels 32 and 33, a front panel 34, a rear panel 36, a floor panel 38 a top panel 37, and a door panel 40. Each of the panels would configure to the particular surface that the panels would be mounted, and therefore each of the panels when mounted on the respective exterior walls of the dryer would form a total exterior insulation system 42 as illustrated in FIG. 4. As is seen in FIG. 3, for example, panel 32 has been mounted onto side 14, panel 34 has been mounted onto front wall 18, panel 40 has been mounted onto door 28, panel 37 has been mounted onto top wall 20, panel 36 has been mounted onto rear wall 21, and panel 38 has been mounted onto the floor portion 22 of dryer 10. As is illustrated, each of the panels when mounted meet at a common edge 44, and therefore, form a means to totally insulate the interior 26 of the frame 12 of dryer 10, from the exterior FIG. 4.

Turning again to FIG. 2, there is provided as illustrated in FIG. 2, a means for adhering each of the panels to the respective wall surfaces of dryer 10. This means is illustrated by a series of adhesive strips 46 which are spaced along the interior surface 47 of each of the panels, each of the adhesive strips 46 being the type of adhesive that would adhere to the exterior wall surface of each of the walls of dryer 10, when the panel makes contact thereto. For purposes of construction and shipping, each of the adhesive strips may be provided with a pull-away tape or the like, so that the adhesive material is not exposed until one is ready to mount the panel onto the particular wall panel of dryer 10.

Turning again to FIG. 3, as illustrated each of the panels have been mounted on the respective walls, which, as was stated earlier, the edges of each of the panel meeting at a common edge 44 along the side, top, and bottom of the rear walls. In order to assure that there is no leakage of heat at the juncture of each of the panels, there is further provided a strip of insulator tape 48, which would overlap at each of the edges as illustrated in FIG. 3, and once in place (see FIG. 4), would again assure that none of the heat contained within the interior 26 of dryer 10 would be released into the surrounding atmosphere. As is further illustrated, the door member 28 is provided with a separate panel 40, which likewise is adhesively secured onto the door, so that even the door 28 is insulated during use.

The type of material that would normally be utilized through each of the panels would normally be a type of insulation that would be up to a certain thickness, and include an interior facing foil layer, with a durable outer exterior surface to appear to be like the manufactured exterior and to resemble the manufactured appearance of the dryer when purchased. Colors could be available in typical clothes dryer colors. Also, for purposes of construction, of course any of the necessary air intakes 49 and exhaust 48 would be provided, for example, in rear panel 47, to allow the typical intake and exhaust as is required FIG. 2.

Figure 5:
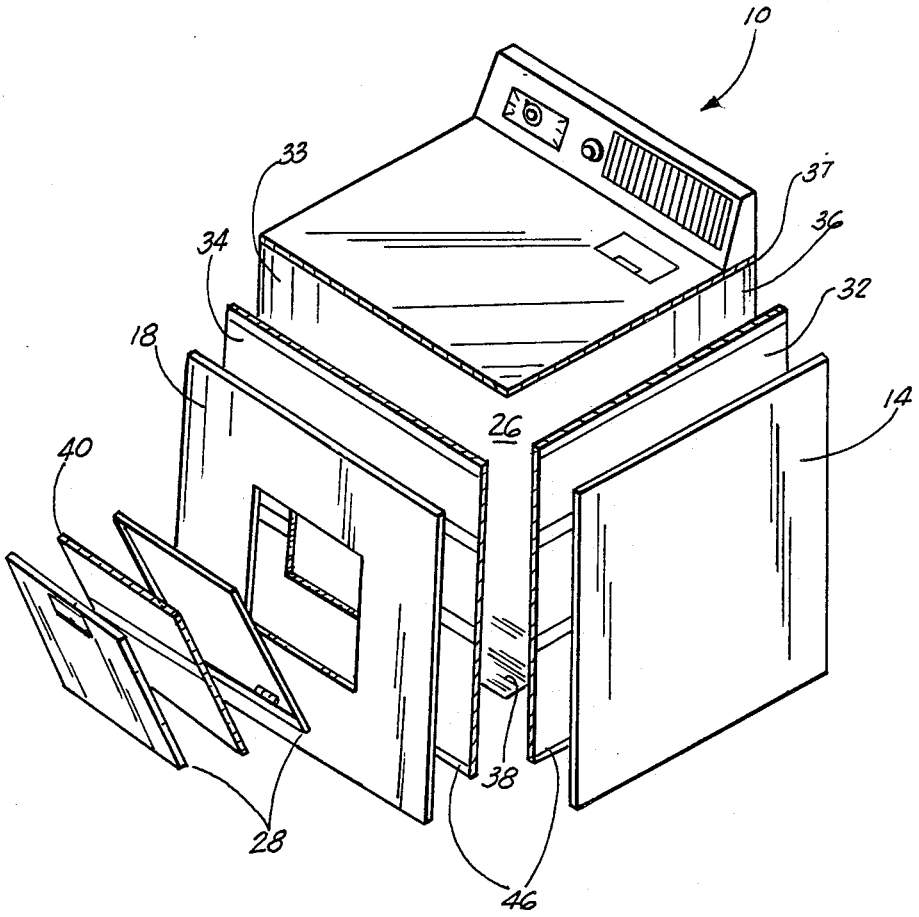
FIG. 5 illustrates an overall view of a dryer with the interior insulation system of the present invention.

An additional embodiment of the invention FIG. 5, would be similar types of panels utilized on the exterior of the dryer, but without the durable outer exterior colored surface. The only difference in the system is that the panels on the interior system of the dryer would be mounted on the interior surface of each of the walls of the dryer, again through adhesive strips 46, and the foil surface facing the interior of the dryer. Edge trim is not required with the use of the interior system. All the insulation is applied on the interior surface of each of the walls and between the walls of the door 28, FIG. 5.

For purposes of the type of insulation, it could be a typical type of UL approved insulation of a thickness which would be required in order to properly insulate and maintain the heat within the dryer during the drying process. The exterior system could be purchased in a set of desired colored panels, again with adhesive taped over, and the interior system could be easily applied to a dryer that is presently in use, or could be applied by the factory during the assembly process of clothes dryers.

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed as invention is:

1. A system for insulating an automatic clothes dryer of the type having a plurality of side walls, a floor portion and a top portion, defining an interior space for housing a rotatable drum for tumbling the clothes as heat is directed into the drum of the exterior portion, the system comprising:

(a) a plurality of insulator panels, each of the panels of a particular width and length of the walls of the dryer;

(b) adhesive means positioned on an interior surface of each of the insulation panels, the adhesive means adhering to the exterior of each of the wall portions of the dryer, as the panel is positioned thereupon;

(c) means for positioning, said insulating panels on each of the respective side wall, top wall, and the bottom portion of the dryer, so that each of the panels meet at their respective edge portions; and (d) adhesive means positionable along each of the common edges between the panels, for forming an insulated space interior of the panels for avoiding heat loss as heat is introduced into the drum within the dryer.

2. The system in claim 1, wherein each of the insulator panels would further define a thickness of insulation material including a substantially durable outer exterior of texture and color of similar quality to resemble surface being covered.

3. The system in claim 1, wherein the adhesive means further comprises a plurality of adhesive strips along the interior surface of each of the panels, the adhesive strips being of the type which are exposed upon the peeling off of a tape bearer on the adhesive strip.

4. The system in claim 1, wherein there is further provided a separate insulator panel for the door of the dryer which is hingedly mounted on the front wall of the dryer.

5. The system in claim 1, wherein each of the insulator panels may be of a thickness necessary to confine heat within the interior of the dryer.

6. A process for insulating an automatic clothes dryer of the type having substantially cubical exterior metal framework, an interior drum rotatably within the metal framework, a heat source for providing heat into the metal drum, as clothes are placed into the drum for drying, the method comprising the following steps:

(a) providing a plurality of panels, each of the panels of the width and length of each of the side walls, rear wall, front wall, top portion, and floor portion of the dryer frame;

(b) providing adhesive means on an interior surface of each of the panels;

(c) adhesively securing each of the panels on the respective wall that the panel is configured to the configured shape;

(d) positioning the panels on each of the walls so that the edge of the panels abut the adjacent panels edges to define an insulated space therewithin;

(e) placing a length of edging tape along each of the edges between the panels, so that the interior of the space within the panels is completely confined by the panels of the system; and (f) positioning the panel in the hollow space between the door's interior-exterior walls, or on the exterior door wall.

* * * * *